US005376924A

United States Patent [19]

Kubo et al.

[11] Patent Number: 5,376,924

[45] Date of Patent: Dec. 27, 1994

[54] FIRE SENSOR

[75] Inventors: Tetsuya Kubo; Yukiko Kaji, both of Tokyo; Sigelu Ohtani, Kanagawa, all of Japan

[73] Assignee: Hochiki Corporation, Tokyo, Japan

[21] Appl. No.: 950,470

[22] Filed: Sep. 24, 1992

[30] Foreign Application Priority Data

| | | | |
|---|---|---|---|
| Sep. 26, 1991 | [JP] | Japan | 3-247213 |
| Sep. 26, 1991 | [JP] | Japan | 3-247214 |
| Sep. 26, 1991 | [JP] | Japan | 3-247215 |
| Sep. 26, 1991 | [JP] | Japan | 3-247216 |
| Sep. 26, 1991 | [JP] | Japan | 3-247217 |

[51] Int. Cl.[5] ..... G08B 17/10

[52] U.S. Cl. ..... 340/632; 340/634; 73/23.31

[58] Field of Search ..... 340/632, 633, 634; 73/23.21, 23.31, 23.2

[56] References Cited

U.S. PATENT DOCUMENTS

| | | | |
|---|---|---|---|
| 3,765,842 | 10/1973 | Purt | 340/633 X |
| 4,088,986 | 5/1978 | Boucher | 340/634 X |
| 4,630,038 | 12/1986 | Jordan | 340/632 |
| 4,778,113 | 10/1988 | Jewett et al. | 340/632 X |
| 5,053,754 | 10/1991 | Wong | 340/632 |
| 5,146,209 | 9/1992 | Beghelli | 340/632 X |

*Primary Examiner*—John K. Peng
*Assistant Examiner*—Tim Johnson
*Attorney, Agent, or Firm*—Sughrue, Mion, Zinn, Macpeak & Seas

[57] ABSTRACT

A fire sensing method and apparatus for detecting a fire based on the detection of a hydrocarbon gas produced before fire ignition and the detection of a second fire indicating phenomenon. Such other phenomenon may comprise the detection of temperature, radiation or combustion product gases. The detection of hydrocarbon gas may generate a pre-alarm condition which permits the use of higher sensitivity conditions for the second fire indicating phenomenon.

22 Claims, 13 Drawing Sheets

FIRE SENSOR

BACKGROUND OF THE INVENTION

The invention relates to a fire sensing method and a fire sensor apparatus that judges the existence of a fire by sensing gas produced at the time of the fire.

With conventional fire sensing methods and fire sensor apparatuses, it is a basic idea that the existence of a fire is judged by detecting one or more of the various products of the fire, such as smoke, heat or gas caused by fire, and that upon such detection a fire alarm will be generated. Conventionally proposed combination fire sensors involve various sensors, such as a CO gas sensor, a humidity sensor, and a temperature sensor. The more complicated sensors are designed to infer the level of danger in fires and gas leakages by applying fuzzy inference. However, where non-gas criteria are used, unacceptable delays occur in detecting the existence of a fire.

Even where the fire is detected by sensing a gas such as $CO_2$ gas and CO gas, both of which are produced in the combustion process, the detection is made by comparing the gas density with a predetermined threshold level. However, such conventional fire sensors are designed to detect $CO_2$ gas or CO gas produced in the combustion process after ignition. Typically, when the $CO_2$ or CO level reaches a threshold that results in the existence of a fire to be judged, the fire has already grown intense and flames have become widely spread. Accordingly, the conventional sensor has the dangerous problem that the identification of the existence and location of a fire will be delayed.

Further, the mere improvement in fire detection sensitivity to achieve early location of fires creates the problem of erroneous alarms. For highly sensitive devices, increases in $CO_2$ gas due to cigarette smoke or a like non-fire phenomenon cannot be distinguished from increases in $CO_2$ gas due to a fire.

SUMMARY OF THE INVENTION

The invention has been made in view of these conventional problems. Accordingly, an object of the invention is to provide a fire sensor which allows early sensing of a fire by monitoring gases, and also is capable of minimizing erroneous alarms.

A fire sensor in accordance with a first embodiment of the invention comprises a hydrocarbon gas sensor that detects hydrocarbon gas produced at a very early stage of a fire before ignition and a combustion detector for detecting an occurrence of fire in response to an output of the gas sensor.

A fire sensor in accordance with a second embodiment of the invention comprises a hydrocarbon gas sensor that detects hydrocarbon gas produced at a very early state of a fire before ignition, a combustion gas sensor that detects gases produced or changing due to the combustion process after ignition, a prealarm judgment section that judges detection of the hydrocarbon gas by the hydrocarbon gas sensor and then outputs a prealarm, and a fire judgment section that judges the fire from an increase or decrease in the gases detected by the combustion gas sensor after the detection of the hydrocarbon gas has been judged by the prealarm judgment section and then outputs a fire alarm.

In accordance with yet another feature of the invention, there is a fire sensor that uses a combustion gas sensor that is operative to detect any one or more of $CO_2$ gas, CO gas, or $O_2$ gas.

In a further feature of the invention, a fire judgment section judges a fire when, after the detection of hydrocarbon gas has been judged, the $CO_2$ gas or CO gas detected by the combustion gas sensor has increased drastically or the $O_2$ gas detected by the combustion gas sensor has decreased drastically.

As a further feature of the invention, the fire judgment section warns that the environment is being deteriorated when a change in the combustion gases has been detected by the combustion gas sensor, even though there has been no detection of hydrocarbon gas sufficient to create a prealarm condition, the change being an increase in $CO_2$ gas or CO gas or a decrease in $O_2$ gas.

Yet another object of the invention is to provide a combination fire sensor that can surely judge a fire by simple processing while detecting at least two gases out of a plurality of gases to be detected, which gases have been specified from the results of repeated study and analyses made on gases produced during combustion tests from the viewpoint of thermal decomposition process of burning substances.

The fire sensor constructed in accordance with the above features of the invention can locate a fire at an early stage of the fire by sensing the presence of hydrocarbon gas, based on the fact that inflammable hydrocarbon gas is produced as a sign of ignition since hydrocarbon gas is not usually present in the air and is in very small quantities if present.

Further since hydrocarbon gas is not produced as a result of smoking a cigarette or a like non-fire phenomenon, a fire is located by continuity in time between the detection of hydrocarbon gas and the detection of, e.g., $CO_2$ gas or CO gas. Therefore, even if fire detection sensitivity is high, an increase in the $CO_2$ or CO content due to a fire can be distinguished from an increase in the $CO_2$ or CO content due to causes other than a fire, thus allowing the number of erroneous alarms to be reduced to further improve fire judgment reliability.

Finally, where there is a combination of fire sensors having the above constructions, the gases to be detected are preferably specified as $CO_2$ gas, CO gas, and $O_2$ gas and for combustion detection, at least two out of these gases are detected; and changes in the gases are compared before and after a fire, whereby the existence of a fire can be judged with certainty. Since it is only increases that are to be compared with respect to gases $CO_2$ and CO, whereas it is only decreases that are to be compared with respect to $O_2$ gas, and this simple judgment allows simple processing.

DESCRIPTION OF THE PREFERRED EMBODIMENTS

Figure 1:
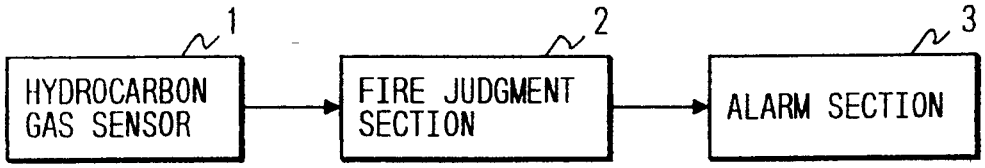
FIG. 1 is a block diagram showing a fundamental inventive concept of the present invention.

FIG. 1 is a block diagram showing a fundamental inventive concept of the present invention. In FIG. 1, reference numeral 1 designates a gas sensor, particularly one for sensing the presence of a hydrocarbon gas within the ambient atmosphere of a space that is the subject of evaluation or monitoring. An example of the sensor is an absorption wavelength detecting type sensor for observing variations in light reception amount, which are caused by light absorption wavelength characteristic of carbon-hydrogen (C-H) coupling of the hydrocarbon gas. Further, either a sensor for discriminating the analysis pattern of the mass spectrum of a hydrocarbon gas or a semiconductor gas sensor having sensitivity in response to an existence of the hydrocarbon gas may be employed as the gas sensor 1.

Reference numeral 2 designates a fire judgement section which compares a gas density of the hydrocarbon gas detected by the gas sensor 1 with a predetermined threshold level that is set for judging the occurrence of fire. An output signal from the judgment section is produced to actuate a fire alarm when the gas density exceeds the threshold.

Figure 2:
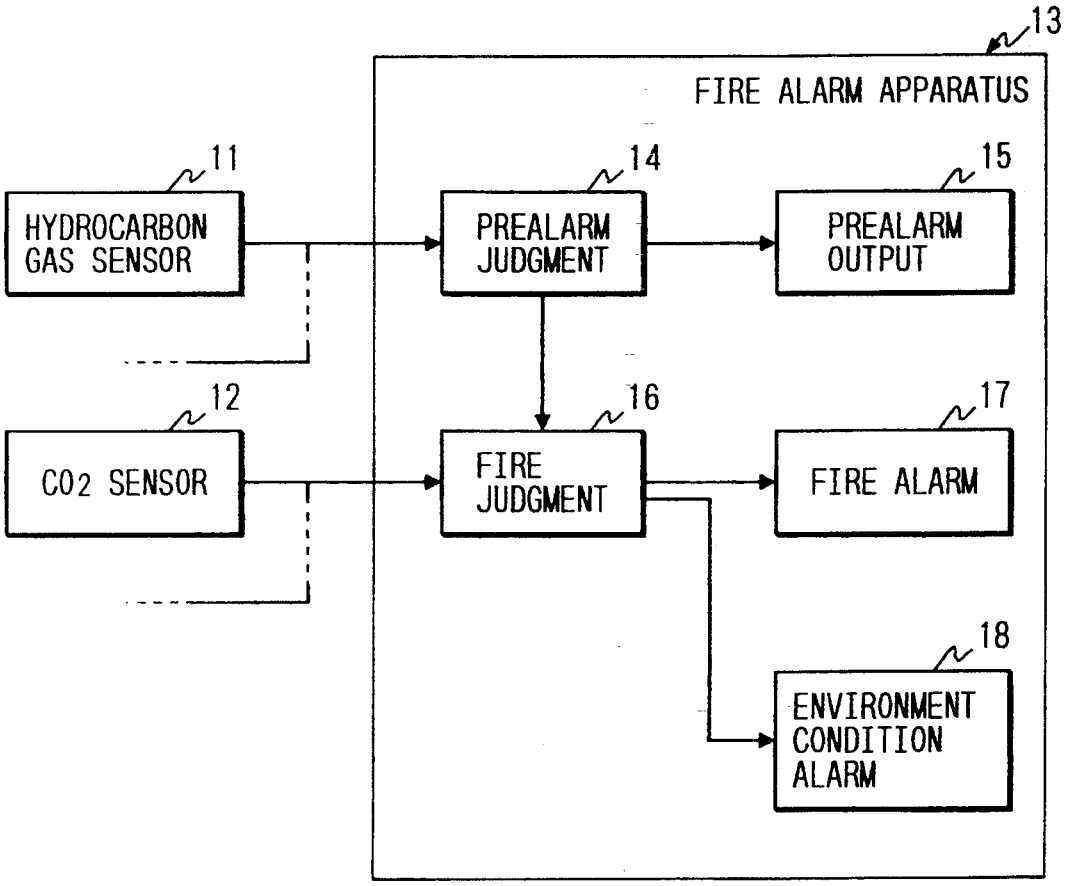
FIG. 2 is a diagram showing a configuration of a first embodiment of the invention.

FIG. 2 is a diagram showing a configuration of a first embodiment of the invention. In FIG. 2, reference numeral 11 designates a hydrocarbon gas sensor that detects inflammable hydrocarbon gas produced during the heating process that occurs before ignition. Reference numeral 12 designates a $CO_2$ sensor serving as a combustion gas sensor which detects $CO_2$ gas produced in the combustion process.

Reference numeral 13 designates a fire alarm system that includes a prealarm judgment section 14, a prealarm output section 15, a fire judgment section 16, a fire alarm section 17, and an environmental condition alarm section 18.

The prealarm judgment section 14 generates a prealarm output upon detection of at least a predetermined amount of hydrocarbon gas by the hydrocarbon gas sensor 11. Prealarm judgment section 14 provides the prealarm judgment output to the prealarm output section 15 and outputs a prealarm by turning an indication lamp on, by buzzing, etc. At the same time, the prealarm judgment section 14 sets a prealarm flag to "ON" and inputs the prealarm flag to the fire judgment section 16.

The fire judgment section 16 judges a fire when the content of $CO_2$ gas detected by the $CO_2$ sensor has been increased drastically with the prealarm flag from the prealarm judgment section 14 being set to "ON", and causes the fire alarm section 17 to generate a judgment output so that a fire alarm will be given.

On the other hand, if a drastic increase in the content of $CO_2$ gas has been judged by the fire judgment section 16 with the prealarm flag from the prealarm judgment section 14 being reset (to "OFF"), the environment condition alarm section 18 generates a judgment output to sound an alarm or turn on a lamp to indicate environmental deterioration by judging that such an increase is brought about by a non-fire cause such as smoking a cigarette or the like because no hydrocarbon gas has been produced.

The reason why hydrocarbon gas is produced prior to a fire, such production of hydrocarbon gas being a basis of the invention, will be described with reference to FIG. 3, which is a characteristic diagram showing measured data.

Figure 3:
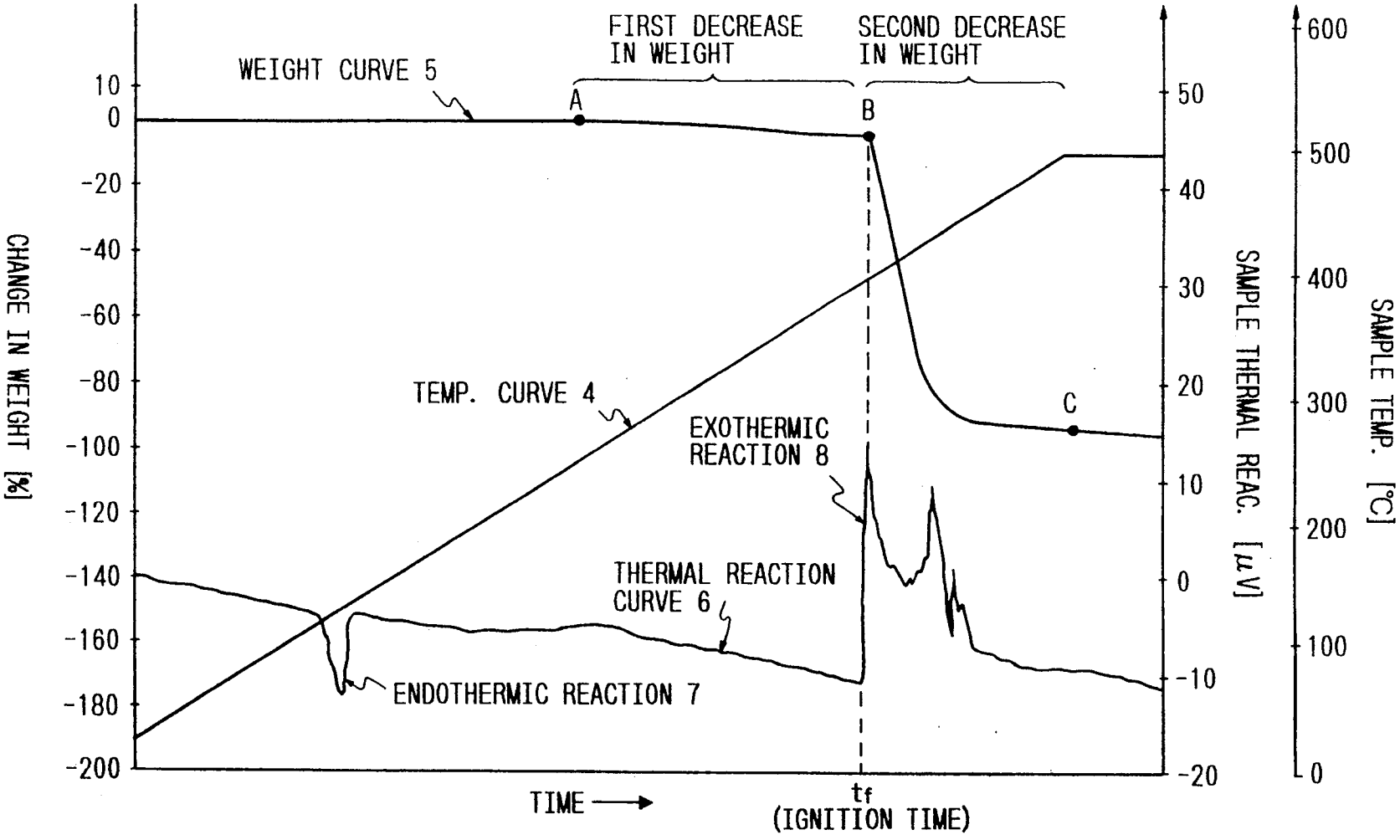
FIG. 3 is a characteristic diagram showing data measured in combustion tests to indicate production of hydrocarbon gas before ignition.

FIG. 3 shows test data obtained when a piece of polyethylene ($p—CH_2CH_2$) as a sample is heated. More specifically, FIG. 3 shows both a change in weight indicated by a weight curve 5 and thermal reaction of the sample indicated by a thermal reaction curve 6 when the piece of polyethylene as a sample is heated at a predetermined gradient from an ambient temperature to 500° C., as indicated by a temperature curve 4. Further, mass spectrometry that is conducted by supplying the gas produced in the combustion tests shown in FIG. 3 to a mass spectrometer will show that carrier gases for the mass spectrometer are: He (80%) and $O_2$ (20%).

In FIG. 3, when the piece of polyethylene as a sample is heated to about 120° C., an endothermic reaction 7 occurs by which the thermal reaction curve 6 drops. The endothermic reaction 7 takes place due to the piece of polyethylene as a sample changing from a solid to a liquid by melting.

As the sample is further heated, the sample is ignited at about 400° C., which coincides with a time tf. This in turn caused such a drastic decrease in weight due to combustion as indicated by a decrease from point B to point C in the weight curve 5 corresponding to the increase in temperature from 400° to 500° C. The thermal reaction curve 6 peaks at the ignition time tf with an exothermic reaction 8.

As determined in accordance with the present invention, when the temperature of the sample is increased from 300° to 400° C. along curve 4 and the weight curve 5 proceeds to point B before ignition at the time tf, a decrease in weight of the sample, although slight, is detected. Specifically, a decrease in weight occurs in a first stage between point A and point B amounting to about 10%. On the other hand, the thermal reaction curve 6 corresponding to points A to B in the weight curve 5 indicates no exothermic reaction. Hence, it is understood that no combustion takes place during this period.

Figure 4:
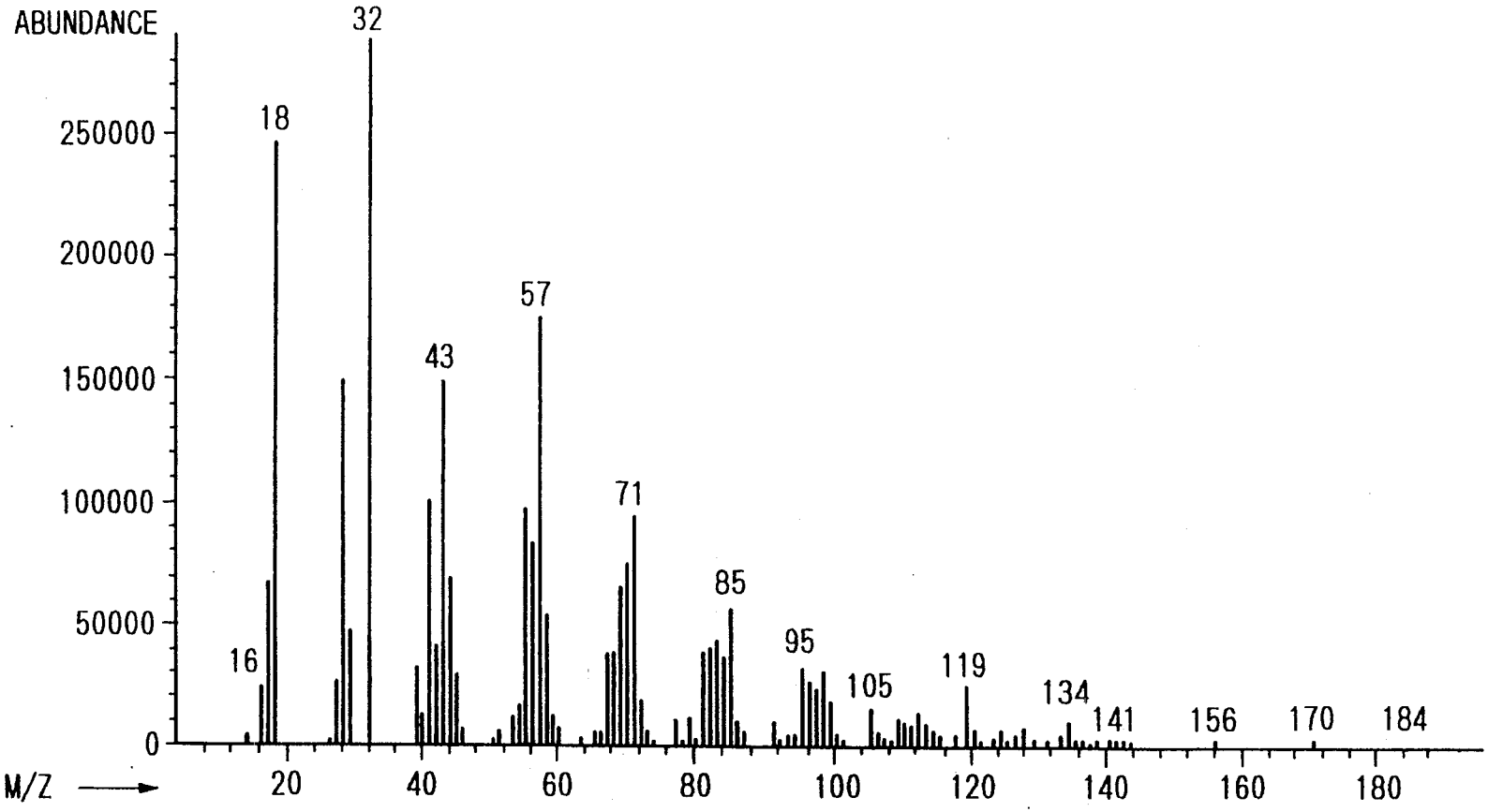
FIG. 4 is a characteristic diagram showing the mass spectrometric result of a gas produced due to reduction in weight before ignition.

The gas produced during a period in which the first-stage decrease in weight takes place and in which the temperature changes from 300° to 400° C. may be subjected to mass spectral analysis in a mass spectrometer. The mass spectrometric result is as shown in FIG. 4. Carrier gases will be: He (80%) and $O_2$ (20%).

The mass spectrum shown in FIG. 4 indicates an extensive distribution from mass number 1 to mass number 140 and peaks observed every increment in mass number by about 14.

Figure 5:
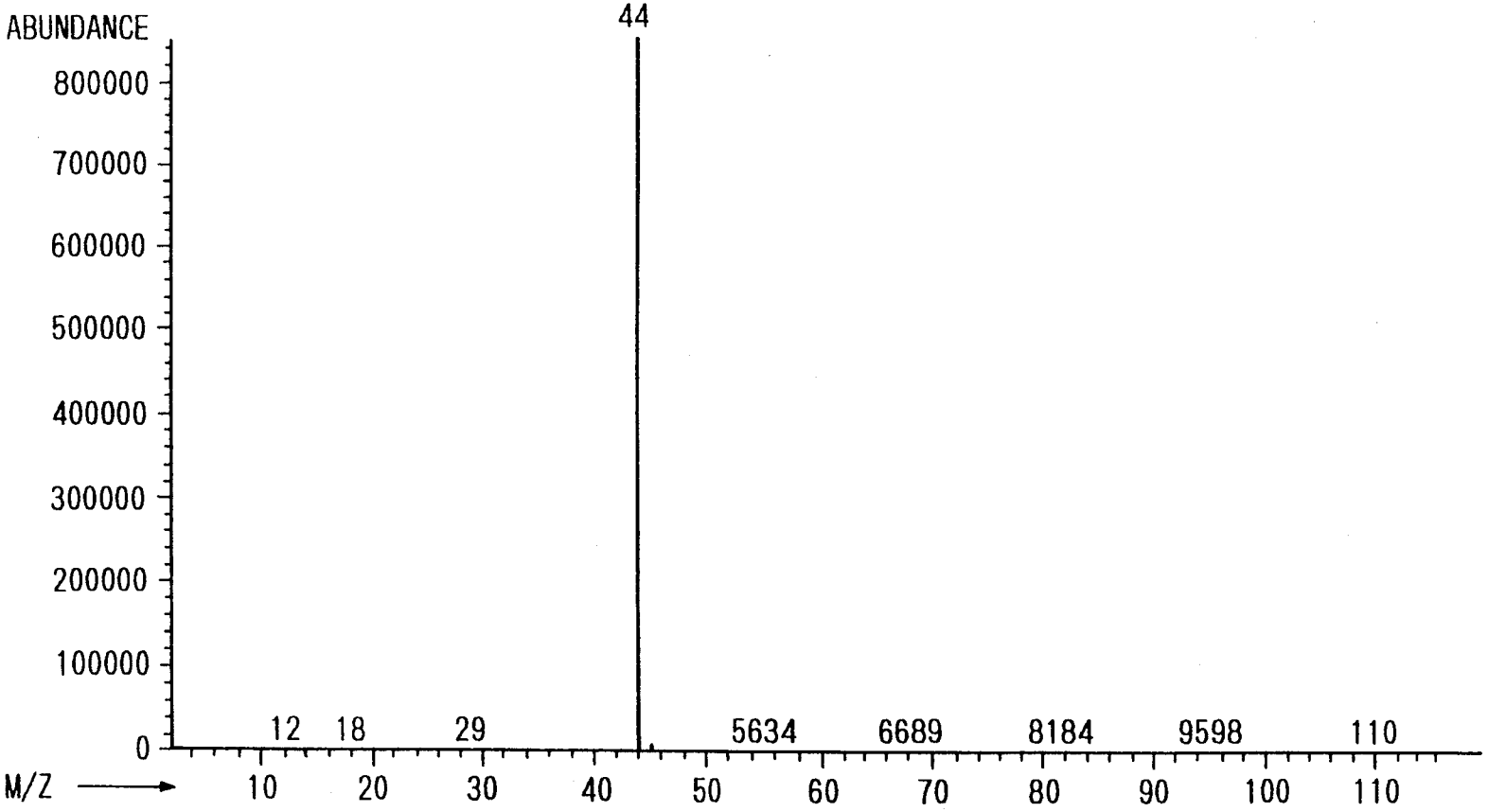
FIG. 5 is a characteristic diagram showing the mass spectrometric result of a gas produced in the combustion process after ignition.

FIG. 5 shows the mass spectrometric result of the gas produced in the combustion process after the time tf. The sole peak is observed at mass number 44, indicating the presence of large amounts of $CO_2$ gas produced in the combustion process. By contrast, the gas produced before combustion shown in FIG. 4 does not exhibit the sole peak at mass number 44 indicating $CO_2$ gas, so that the former gas is quite different from $CO_2$ gas.

The gas having the mass spectral distribution shown in FIG. 4 is considered as an "inflammable gas" that contains carbon whose mass number ranges from about 1 to 10. Such gas is an inflammable hydrocarbon gas.

On the basis of a detection of such inflammable gas, the invention allows early location of a fire, specifically in this case by sensing hydrocarbon gas produced at an early stage before ignition. By this process, the invention permits more accurate fire judgment by sensing a drastic increase in $CO_2$ gas or CO gas as the combustion gas produced after ignition or a drastic decrease in $O_2$ gas and by sensing continuity in time in detecting both hydrocarbon gas and the gases produced in the combustion process.

Figure 6:
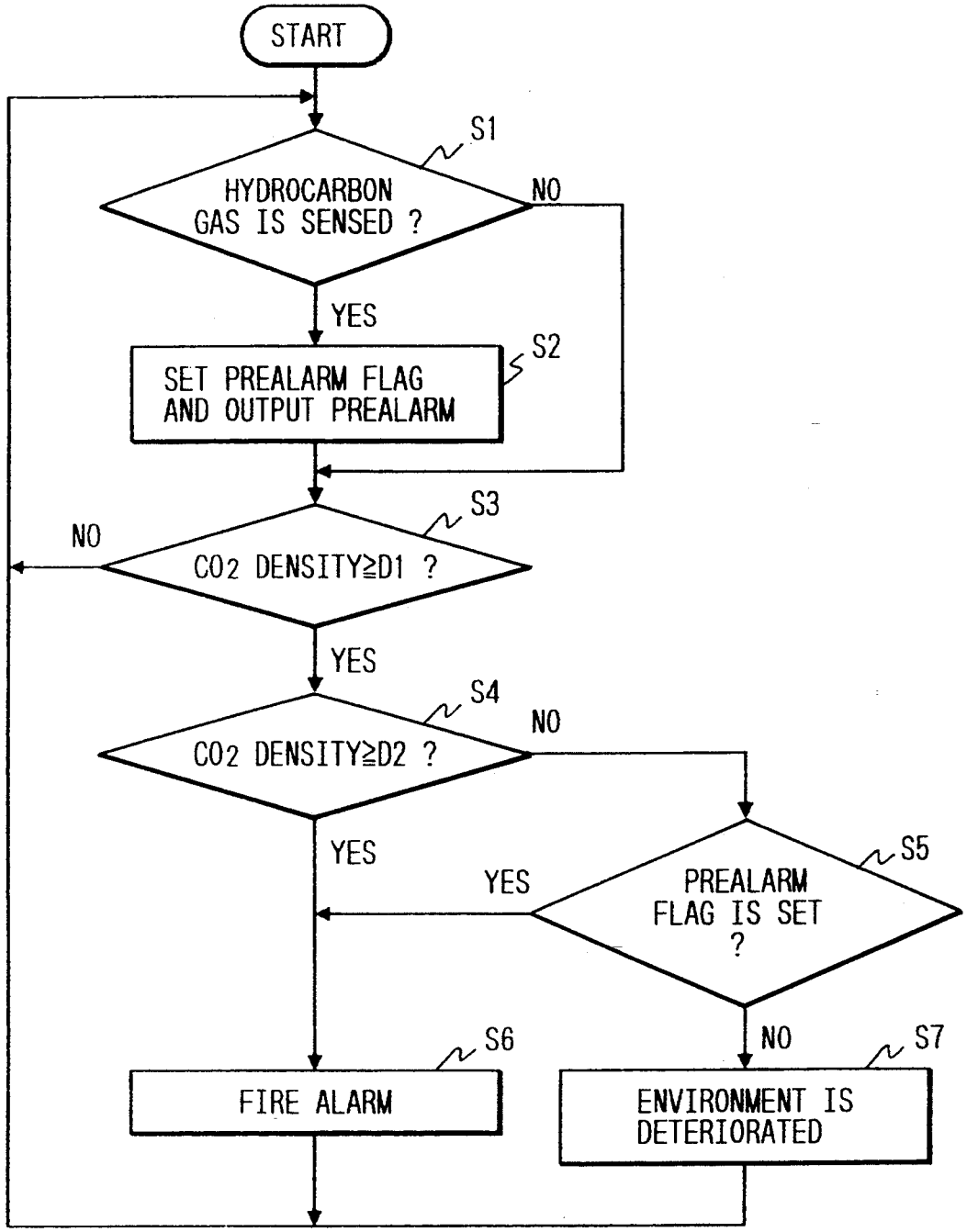
FIG. 6 is a flowchart showing the processing of the embodiment shown in FIG. 1.

FIG. 6 is a flowchart showing the operation of the fire sensor 13 provided in the first embodiment of the invention. In FIG. 6, the sensing of hydrocarbon gas is checked in Step S1. Upon sensing hydrocarbon gas by the prealarm judgment section 14, the processing proceeds to Step S2 to set the prealarm flag to "ON" and a prealarm is then outputted by the prealarm output section 15.

Successively, the fire judgment section 16 judges whether or not the content of $CO_2$ gas detected by the $CO_2$ sensor is greater than or equal to a lower threshold D1, which is one of thresholds D1, D2 defined in two levels. If the content exceeds D1, the processing proceeds to Step S4 to check if the content exceeds the higher threshold D2. If the content is found to be below the higher threshold D2 in Step S4, it is checked whether the prealarm flag is set to "ON" or "OFF" in Step S5. If hydrocarbon gas has been detected and if the prealarm flag has been set to "ON" at this point, it can be judged that a fire is present if there is continuity in time from the detection of hydrocarbon gas to the detection of $CO_2$ gas. This period of time may be variably set, on the basis of experience and desired sensitivity. Once the presence of a fire has been judged, a fire alarm is then given in Step S6.

On the other hand, in an explosive fire no hydrocarbon gas is detected because there is little heating time before ignition. Thus, in this case, the processing proceeds from Step S1 to Step S3, and then to Step S4 because the content of $CO_2$ gas exceeds the lower threshold D1. At the time, the processing jumps to Step S6 to sound a fire alarm because the content of $CO_2$ gas also exceeds the higher threshold D2.

Further, if the content of $CO_2$ gas has been increased due to smoking a cigarette or a like non-fire phenomenon, no hydrocarbon gas is detected. Therefore, the processing would proceed from Step S1 to Step S3. When the content $CO_2$ gas exceeds the lower threshold D1, the processing proceeds to Step S4, and since the content of $CO_2$ gas is below the higher threshold D2, the processing then proceeds to Step S5. Since the prealarm flag indicating the detection of hydrocarbon gas is found to be set to "OFF" in Step S5, the processing proceed to Step S7 to warn that the environment is being deteriorated.

While the $CO_2$ sensor 12 has been used as the combustion gas sensor in the first embodiment shown in FIG. 2, a CO sensor detecting CO gas may be used in place of the $CO_2$ sensor. Further, although the illustration in FIG. 2 shows only the sensors provided in a single alarm section, a plurality of hydrocarbon sensors 11 and $CO_2$ sensors 12 may be provided for each of one or more alarm regions and may be connected to either a central or distributed fire alarm system 13. Moreover, combinations of gas sensors may be used as the combustion sensors, as further taught herein.

Figure 7:
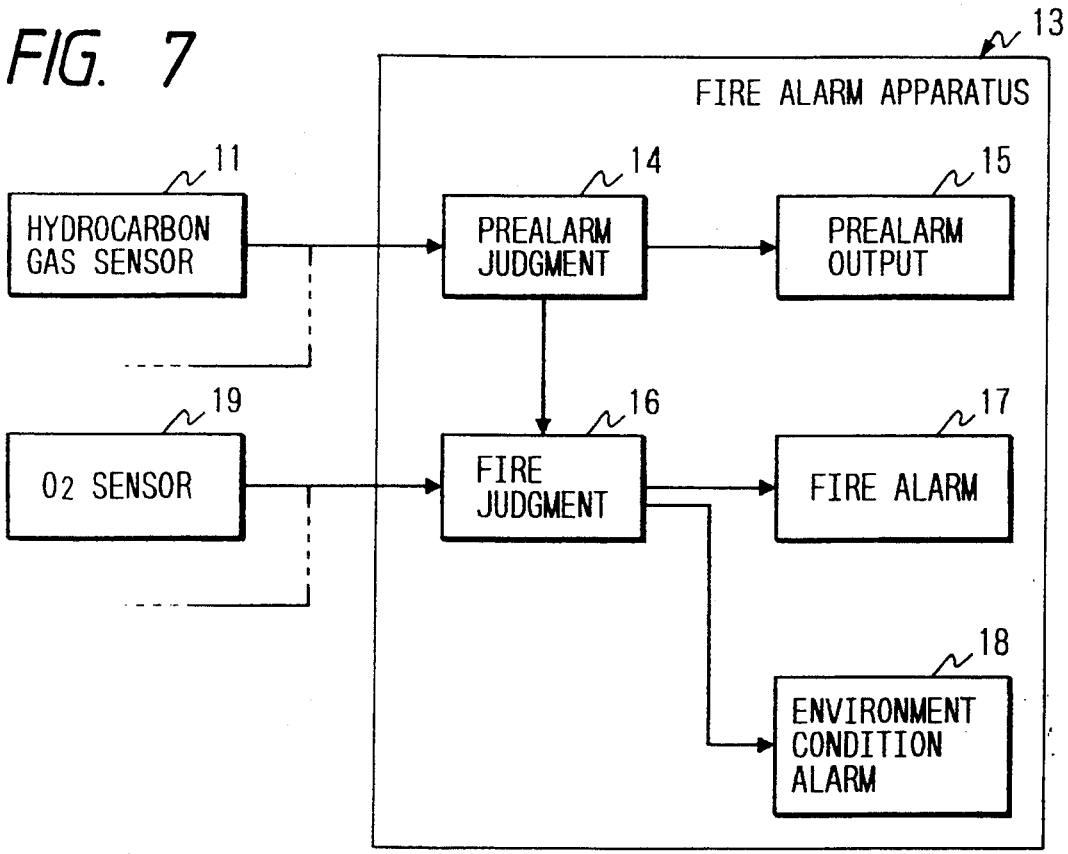
FIG. 7 is a diagram showing a configuration of a second embodiment of the invention.

FIG. 7 is a diagram showing a configuration of a second embodiment of the invention. Instead of the $CO_2$ sensor 12 arranged in the first embodiment shown in FIG. 2, an $O_2$ sensor 19 is provided as a combustion gas sensor. Since the other aspects of the configuration are the same as those shown in FIG. 2, the same reference numerals are used and their description will be omitted.

In the second embodiment shown in FIG. 7, a drastic decrease in $O_2$ gas is detected by the $O_2$ sensor 19 in the combustion process after ignition. On condition that the prealarm flag is set to "ON" at the fire judgment section 16 as a result of the detection of hydrocarbon gas by the prealarm judgment section 14, the presence of a fire is judged when the content of $O_2$ gas is, for example, below the higher one of two-level thresholds. This judgment is made in a manner similar to that shown in Step S3 in the flowchart of FIG. 6, and a fire alarm is given. Where no hydrocarbon gas has been initially detected, as in the case of explosive fires, the presence of a fire is detected upon finding that the content of $O_2$ gas falls below the higher threshold and, successively, the lower threshold. Where both thresholds are passed, typically within a given period of time, a fire alarm is given. Further, in the case where $O_2$ gas has been decreased due to smoking a cigarette or like non-fire phenomenon, an alarm indicating environmental deterioration is given when the content of $O_2$ gas falls below the higher threshold on condition that the prealarm flag is set to "OFF".

While judgment of fires is carried out using predetermined thresholds with respect to increases in $CO_2$ or CO gas or decreases in $O_2$ gas produced in the combustion process, such judgment may be based on a rate of increase or decrease per unit time, i.e., a differential. Further, fire judgment may be made on the basis of predicting increases or decreases in the gas content by sampling a plurality of pieces of data and calculating coefficients of, e.g., a quadratic function.

Figure 8:
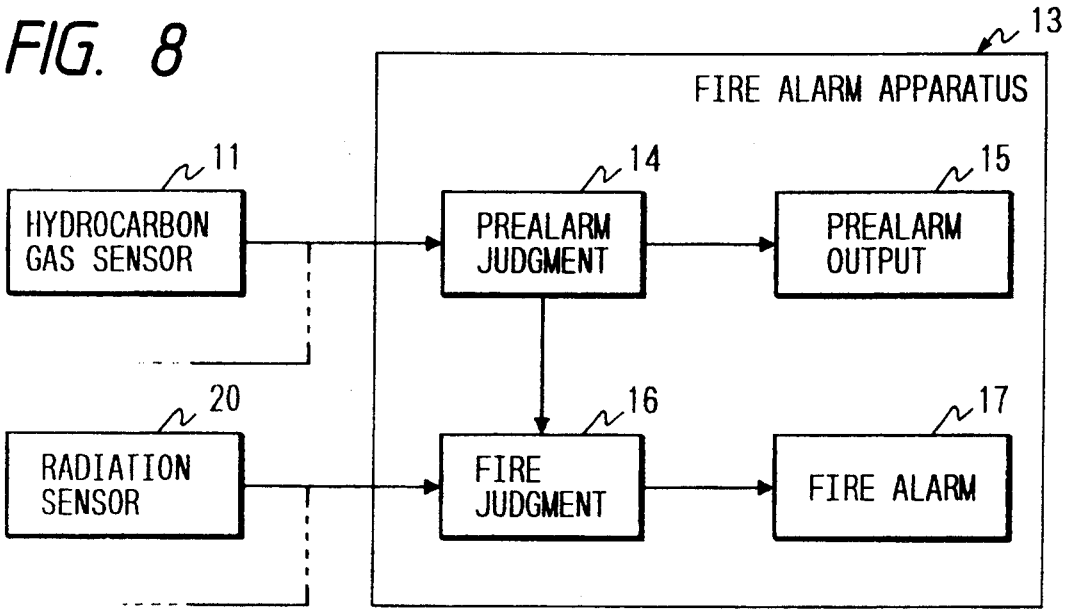
FIG. 8 is a diagram showing a configuration of a third embodiment of the invention.

FIG. 8 is a diagram showing a configuration of a third embodiment of the invention. In FIG. 8, reference numeral 20 designates a radiation sensor, such as pyroelectric element having a detection sensitivity in the infrared region, and senses radiated heat by exothermic reaction in the combustion process. The other blocks FIG. 8 which are similar in function to those of FIG. 2 bear the same reference numerals, respectively.

The prealarm judgment section 14 outputs a prealarm from the prealarm output section 15 while judging the sensing of hydrocarbon gas by the hydrocarbon gas sensor 11. The prealarm judgment section 14 also sets a prealarm flag to "ON" upon judgment of the sensing of hydrocarbon gas, the prealarm flag being delivered to the fire judgment section 16.

The fire judgment section 16 judges the intensity of the radiated heat that has been detected by the radiation sensor 20. A fire is judged upon detection of an increase in radiated heat subsequent to the detection of hydrocarbon gas when the intensity of the radiated heat detected by the radiation sensor 20 exceeds a threshold with the prealarm flag being set to "ON". The fire judgment section then causes the fire alarm section 17 to sound a fire alarm.

Figure 9:
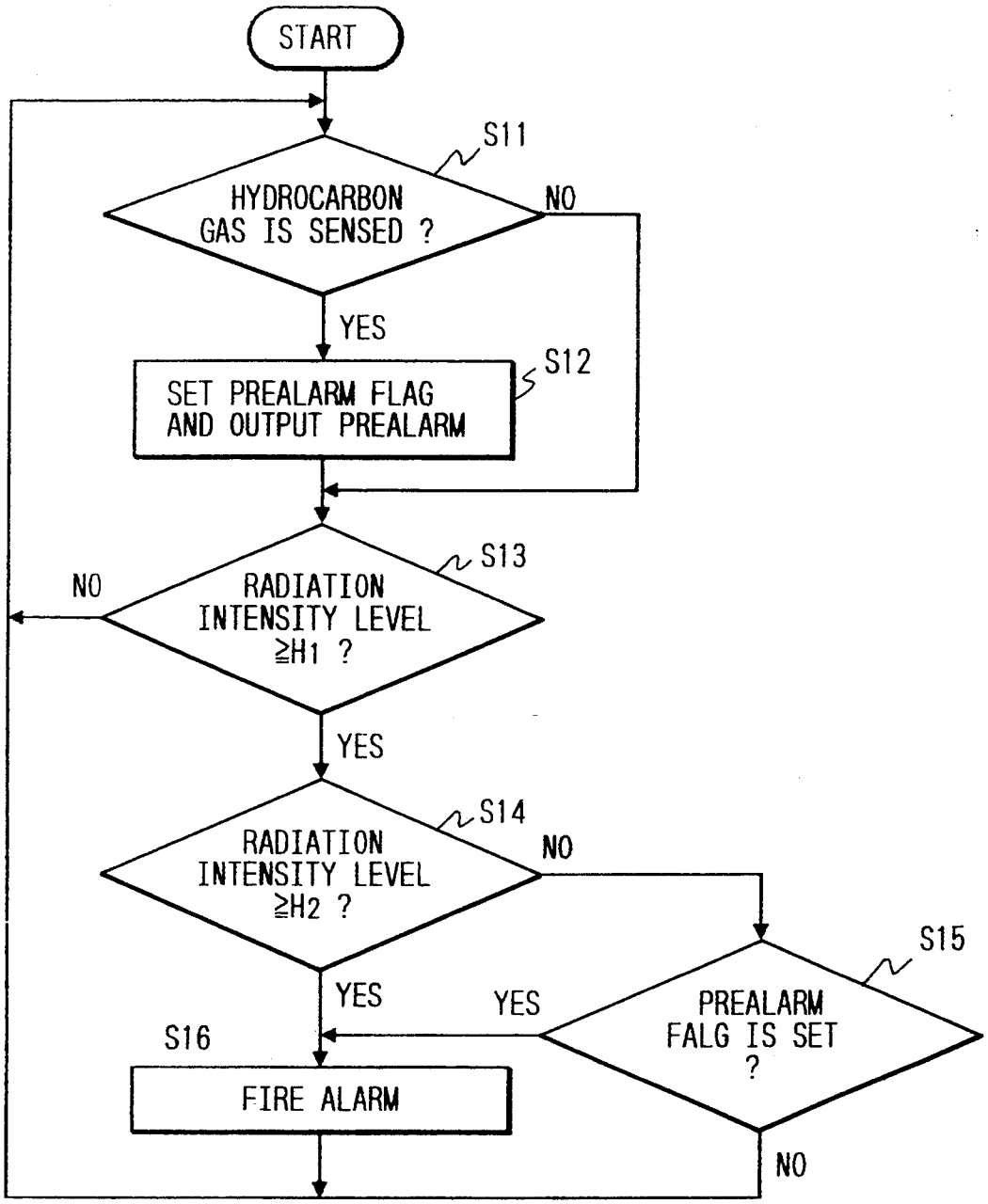
FIG. 9 is a flowchart showing the processing of a fire sensor 13 shown in FIG. 8.

FIG. 9 is a flowchart showing the processing of the fire alarm apparatus 13 shown in FIG. 8. In FIG. 9, it is checked if the hydrocarbon gas sensor 11 has sensed hydrocarbon gas in Step S11. When the sensing of hydrocarbon gas has been judged at the prealarm judgment section 14, the processing proceeds to Step S12, where not only the prealarm flag to the fire judgment section 16 is set to "ON", but also a prealarm is outputted by the prealarm output section 15.

Then, in Step S13, the fire judgment section 16 compares the intensity of radiated heat detected by the radiation sensor 20, i.e., a radiation intensity level with a lower threshold H1 out of thresholds defined in two levels. If the radiation intensity level is greater than or equal to the threshold H1, then the processing proceeds to Step S14, where the radiation intensity level is compared with the higher threshold H2. If the radiation intensity level is smaller than the threshold H2, the processing proceeds to Step S15. If the prealarm flag is set to "ON" by the sensing of hydrocarbon gas, then the processing proceeds to Step S16 to sound a fire alarm.

On the other hand, explosive fires do not undergo the process of producing hydrocarbon gas. With no sensing of hydrocarbon gas, the processing proceeds from Step S11 to Step S13. An explosive fire exhibits a drastic increase in radiated heat, the increase exceeding not only the lower threshold H1 but also the higher threshold H2. As a result, the processing jumps to Step S16 to directly give a fire alarm.

Further, if it is found out that no hydrocarbon gas has been sensed in Step S11 and if the radiation intensity level has been found to exceed the lower threshold H1 in Step S13, which in turn causes the processing to proceed to Step S15, then no fire alarm is given while judging that the increase in radiation intensity level is not derived from fire but from, e.g., heat from an oil-stove with the prealarm flag being set to "OFF". The processing is then returned to Step S11.

In the embodiment shown in FIG. 8, it is designed to give a prealarm when hydrocarbon gas has been sensed by the hydrocarbon gas sensor 11 with providing the prealarm judgment section 14 and the prealarm output section 15. It may, however, be so arranged that a fire is judged when, within a predetermined time, a hydrocarbon gas has been first sensed and the intensity of radiated heat exceeding predetermined thresholds is then sensed, without giving a prealarm.

Further, while fire judgment is made by comparing the intensity of the radiated heat detected by the radiation sensor 20 with the thresholds, fire judgment may be made based on an increment in radiated heat per unit time (a differential value), or on the prediction of a change in radiated heat by calculating coefficients of a quadratic function while sampling a plurality of intensities of the radiated heat.

Still further, since the hydrocarbon gas is produced at a sufficiently high temperature before ignition, a fire may be located early by giving a prealarm or a fire alarm when hydrocarbon gas has been sensed even before ignition and when the intensity of the radiated heat exceeding a predetermined threshold has been sensed.

Figure 10:
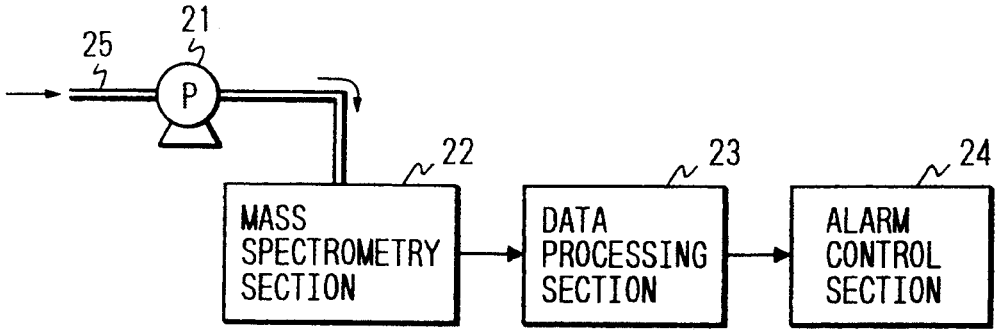
FIG. 10 is a diagram showing a configuration of a fourth embodiment of the invention.

FIG. 10 is a diagram showing a configuration of a fourth embodiment of the invention. In FIG. 10, reference numeral 22 designates a mass spectrometry section, which receives a gas to be subjected to mass spectrometry by a sampling pump 21 while using a piping 25 disposed in a monitoring area. This mass spectrometry section 22 is designed to obtain the mass spectrometric result in a narrow range including mass numbers 43, 44, and 45.

That is, the mass spectrometry section 22 has the same structure as an ordinary mass spectrometer capable of obtaining mass spectra covering a wide range of mass numbers. Since the mass numbers to be detected are limited to 43, 44, and 45, the sensing distances at the time of sensing with electrodes can be made as short as those corresponding to the mass numbers 43, 44, and 45 by sputtering ionized gas molecules. As a result, the structure of the mass spectrometry section 22 can me made extremely simple compared with ordinary mass spectrometers.

Figure 11:
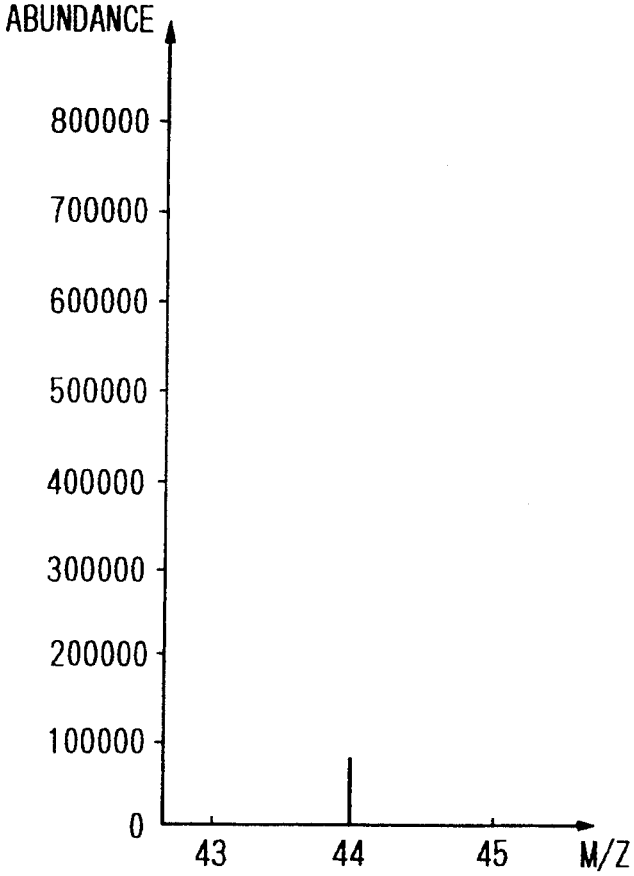
FIG. 11 is a diagram showing a spectral pattern which is a reference pattern indicating a spectrum in a normal, non-fire environment.
Figure 12:
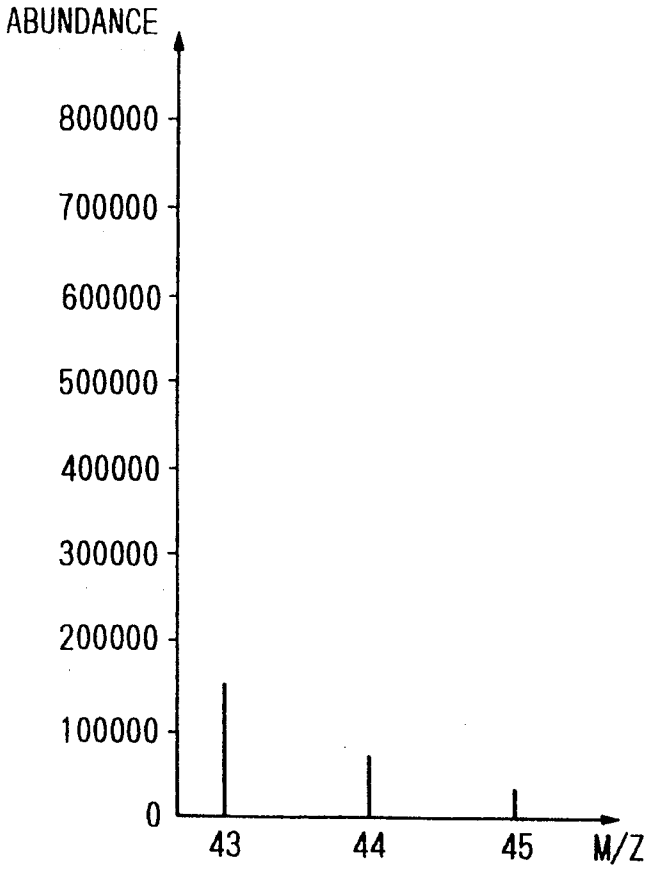
FIG. 12 is a diagram showing a spectral pattern which is a reference pattern for judging hydrocarbon gas produced at a very early stage of a fire before ignition.

The mass spectral data in the narrow range of mass numbers 43, 44, and 45 obtained by the mass spectrometry section 22 are supplied to a data processing section 23. The data processing section 23 stores spectral patterns, A spectral pattern shown in FIG. 11 is a reference pattern indicating a spectrum in a normal, non-fire environment. A spectral pattern shown in FIG. 12 is a reference pattern for judging hydrocarbon gas produced at a very early stage of a fire before ignition. A spectral pattern shown in FIG. 13 is a reference pattern showing the mass spectrum of gases including $CO_2$ gas in addition to hydrocarbon gas produced by ignition.

Figure 13:
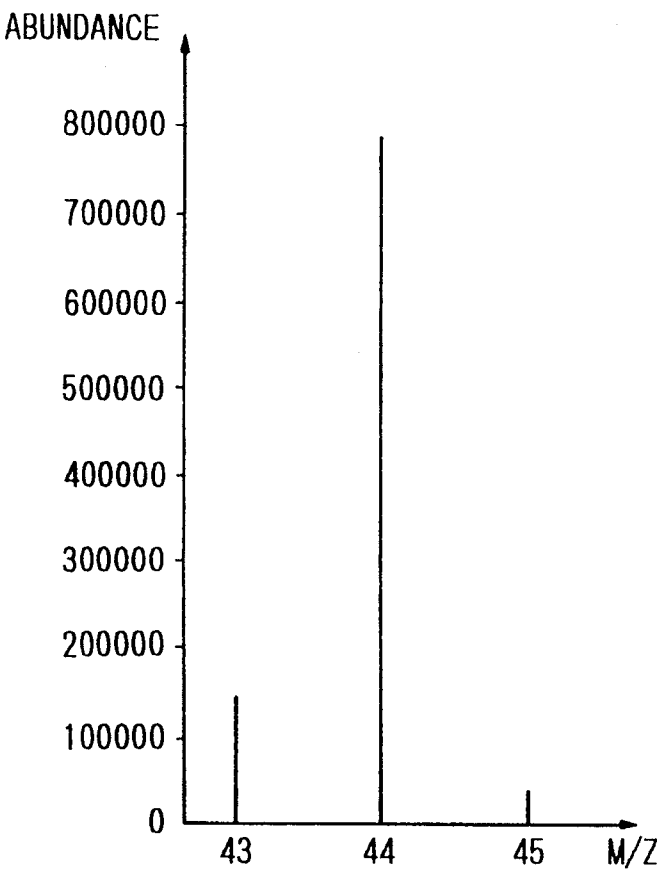
FIG. 13 is a diagram showing a spectral pattern which is a reference pattern showing the mass spectrum of gases including $CO_2$ gas in addition to hydrocarbon gas produced by ignition.

Thus, the data processing section 23 executes pattern matching between a mass spectrum actually obtained by the mass spectrometry section 22 and the reference spectral patterns shown in FIGS. 11, 12, and 13, and judges a fire when the spectral pattern including the $CO_2$ gas shown in FIG. 13 is obtained after the spectral pattern of hydrocarbon gas shown in FIG. 12 has been obtained. Once the fire has been judged, the data processing section 23 causes an alarm control section 24 to output an alarm and carry out necessary control.

The technique for judging a fire by carrying out mass spectrometry in such a narrow range covering mass numbers 43, 44, and 45 in the invention is based on the fact that hydrocarbon gas is produced in the course of heating before ignition, which is a new fact that the inventors have found through tests on combustion in fire involving mass spectrometry.

A further embodiment of the invention concerns yet another way that the presence of combustion may be determined, for use alone or in combination with hydrocarbon gas detection as described previously. In this regard, the following three theorems have been determined from the results of analyses made on gases produced in the combustion process.

[Theorem 1] The production of CO and $CO_2$ and the consumption of $O_2$ take place simultaneous.

[Theorem 2] Neither CO nor $CO_2$ is produced singly.

[Theorem 3] The presence of $O_2$ has little dependance on the fact that CO is produced in small amounts and $CO_2$ is produced in large amounts during combustion.

The following four types of fire sensors may be based on the theorems 1 to 3.

CONSTRUCTION 1

A combination fire sensor includes:

a $CO_2$ sensor for detecting $CO_2$ gas produced at a fire;

a CO sensor for detecting CO gas produced at the fire; an $O_2$ sensor for detecting $O_2$ gas decreasing at the fire; and a comparison and calculation section for giving an alarm by judging the fire when the content of the $CO_2$ gas detected by the $CO_2$ sensor and the content of the CO gas detected by the CO sensor have been increased and when the content of the $O_2$ gas detected by the $O_2$ sensor has been decreased.

CONSTRUCTION 2

A combination fire sensor includes:

a $CO_2$ sensor for detecting $CO_2$ gas produced at a fire;

an $O_2$ sensor for detecting $O_2$ gas decreasing at the fire; and a comparison and calculation section for giving an alarm by judging the fire when the content of the $CO_2$ gas detected by the $CO_2$ sensor has been increased and when the content of the $O_2$ gas detected by the $O_2$ sensor has been decreased.

CONSTRUCTION 3

A combination fire sensor includes:

a CO sensor for detecting CO gas produced at a fire;

an $O_2$ sensor for detecting $O_2$ gas decreasing at the fire; and a comparison and calculation section for giving an alarm by judging the fire when the content of the CO gas detected by the CO sensor has been increased and when the content of the $O_2$ gas detected by the $O_2$ sensor has been decreased.

CONSTRUCTION 4

A combination fire sensor includes:

a $CO_2$ sensor for detecting $CO_2$ gas produced at a fire;

a CO sensor for detecting CO gas produced at the fire; and a comparison and calculation section for giving an alarm by judging the fire when the content of the $CO_2$ gas detected by the $CO_2$ sensor has been increased and when the content of the CO gas detected by the CO sensor has been increased.

As previously noted, the four constructions may be used alone and have significant advantages over the conventional designs or may be used in connection with a hydrocarbon detector for even further accuracy. The arrangement and operation of these basic constructions will now be described.

Figure 14:
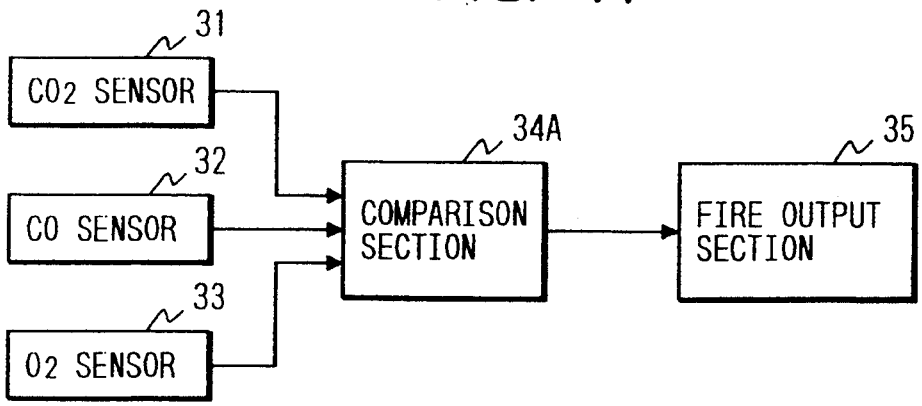
FIG. 14 is a diagram showing a basic three-variable configuration of another embodiment of the invention.

FIG. 14 is a diagram showing a configuration of another embodiment of the invention. In FIG. 14, a $CO_2$ sensor 31, a CO sensor 32, and an $O_2$ sensor 33 are provided so that the embodiment can detect all combustion gases $CO_2$, CO, and O2 which are objects to be detected, respectively. The output of each of the $CO_2$ sensor 31, the CO sensor 32, and the $O_2$ sensor 33 is fed to a comparison section 34A. The comparison section 34A performs processing shown in the flowchart of FIG. 15, and outputs an alarm while applying a fire output signal to a fire output section 35 when a fire has been judged.

Figure 15:
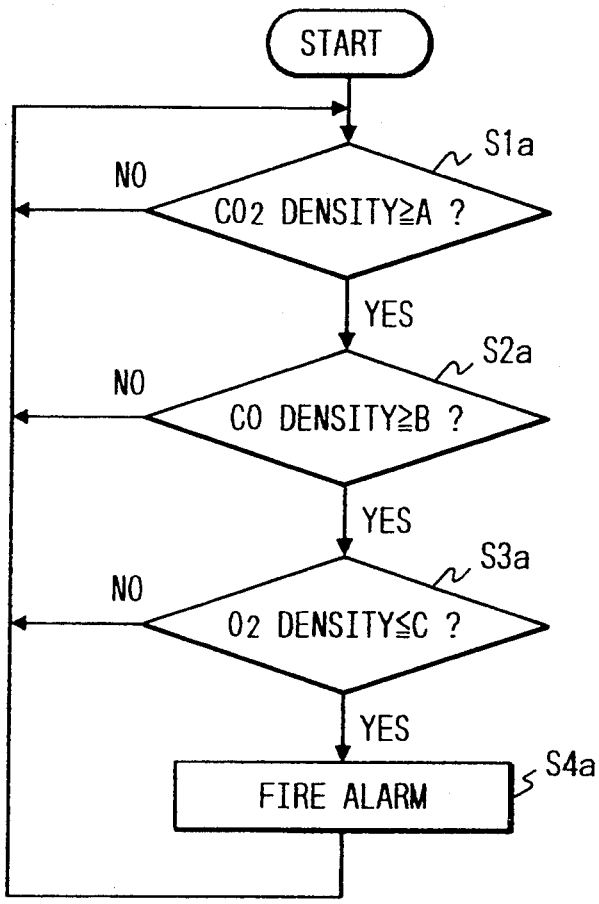
FIG. 15 is a flowchart showing the processing of a fire sensor shown in FIG. 14.

The processing at the comparison section 34A shown in FIG. 15 is as follows. In Step S1a, it is judged whether or not the $CO_2$ content detected by the $CO_2$ sensor 31 is greater than or equal to a predetermined threshold A. If the $CO_2$ content is greater than or equal to the threshold A, the processing is proceeded to Step S2a, where it is judged whether or not the CO content detected by the CO sensor 32 is greater than or equal to a predetermined threshold B. If the CO content is greater than or equal to the threshold B, then the processing is proceeded to Step S3a, where it is judged whether or not the $O_2$ content detected by the $O_2$ sensor 33 is smaller than or equal to a predetermined threshold C. If the $O_2$ content is smaller than or equal to the threshold C, then the processing is proceeded to Step S4a, where a fire alarm is given.

The judgment processing of FIG. 15 performed by the comparison section 34A based on the results of detection of $CO_2$, CO, and $O_2$ is an application of all the above-mentioned theorems to fire judgment.

Figure 16:
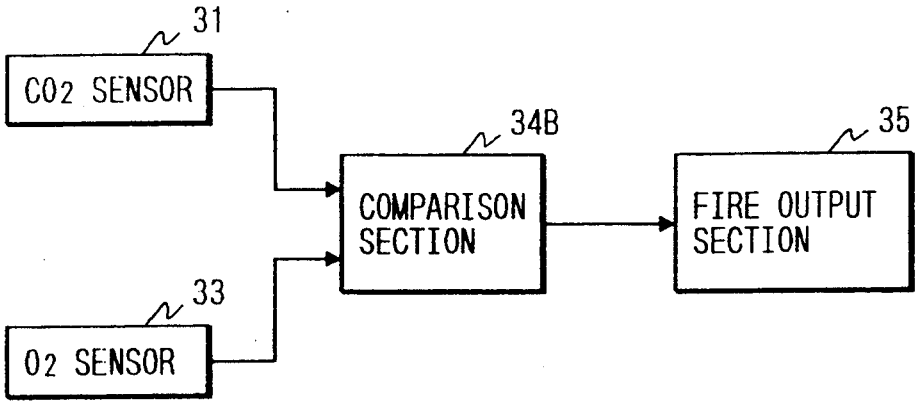
FIG. 16 is a diagram showing a basic two-variable configuration of another embodiment of the invention.
Figure 17:
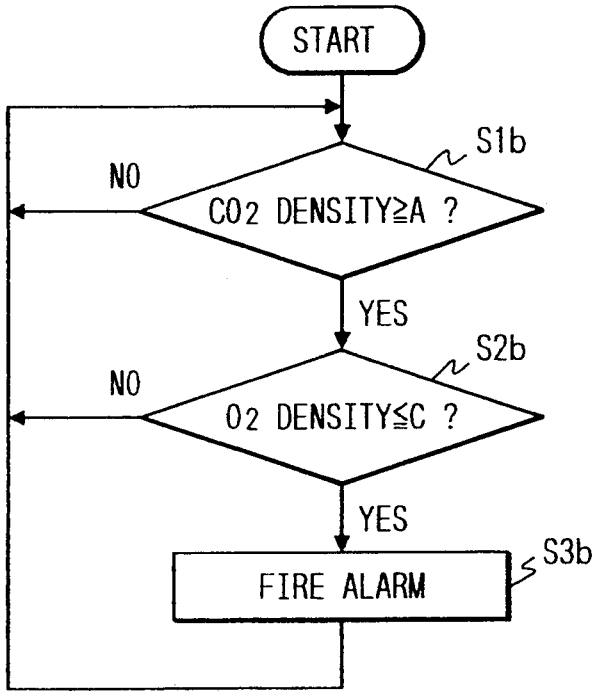
FIG. 17 is a flowchart showing the processing of a fire sensor shown in FIG. 16.

FIG. 16 is a diagram showing a configuration of another embodiment of the invention. This embodiment is characterized as performing processing shown in the flowchart of FIG. 17 by the comparison section 34*b* based on two detection outputs of the $CO_2$ sensor 31 and the $O_2$ sensor 33. More specifically, as shown in the flowchart of FIG. 17, it is judged that the $CO_2$ content is greater than or equal to the threshold A in Step S1b. If the $CO_2$ content is greater than or equal to the threshold A, then the processing is proceeded to Step S2b. In Step S2b, it is judged whether or not the $O_2$ content is smaller than or equal to the threshold C. If the $O_2$ content is smaller than or equal to the threshold C, the processing proceeds to Step S3b, where a fire alarm is given.

Figure 18:
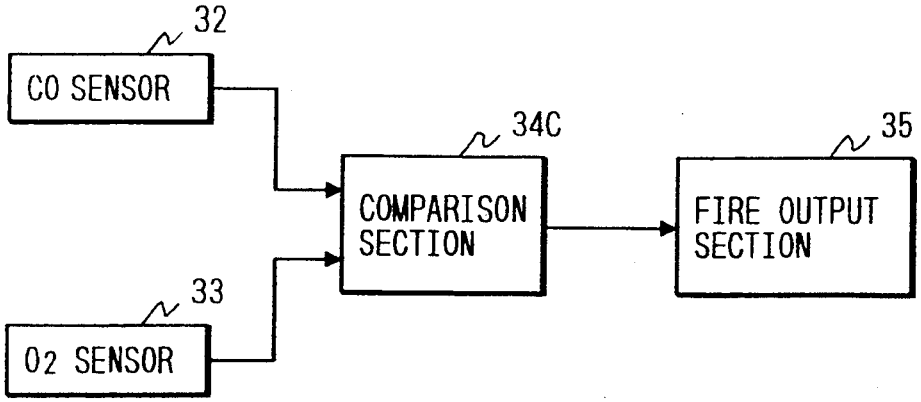
FIG. 18 is a diagram showing a basic configuration of another two-variable embodiment of the invention.
Figure 19:
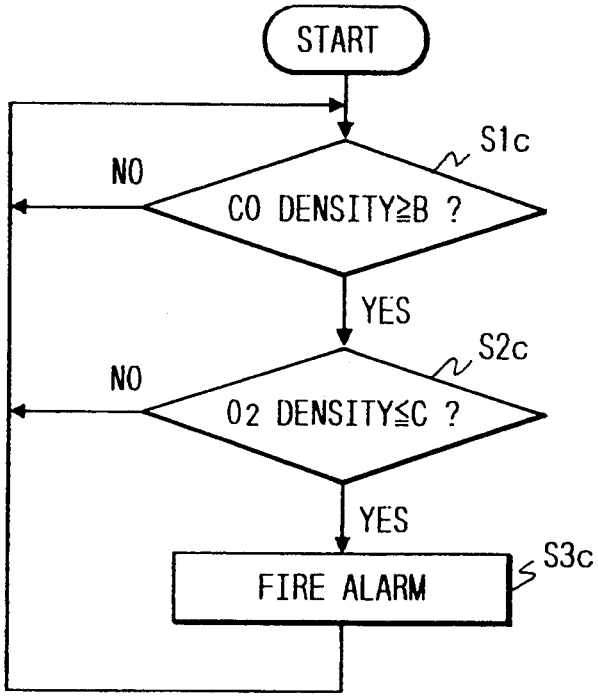
FIG. 19 is a flowchart showing the processing of a fire sensor shown in FIG. 18.

FIG. 18 is a diagram showing a configuration of a further embodiment. This embodiment is characterized as judging a fire by performing processing shown in the flowchart of FIG. 19 by the comparison section 24C while using two detection outputs of the CO sensor 32 and the $O_2$ sensor 33. More specifically, as shown in the flowchart of FIG. 19, it is judged whether or not the CO content is greater than or equal to the threshold B in Step S1c. If the CO content is greater than or equal to the threshold B, then the processing is proceeded to Step S2c. In Step S2c, it is judged whether or not the $O_2$ content is smaller than or equal to the threshold C. If the $O_2$ content is smaller than or equal to the threshold C, the processing proceeds to Step S3c, where a fire alarm is given.

Figure 20:
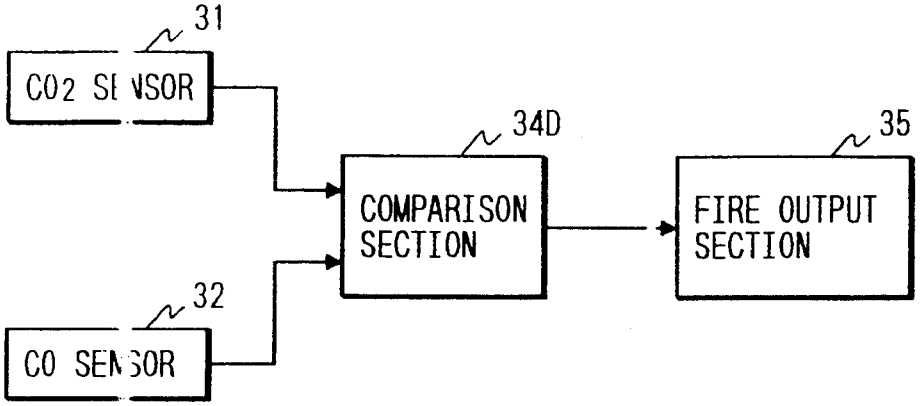
FIG. 20 is a diagram showing another basic two-variable configuration embodiment of the invention.
Figure 21:
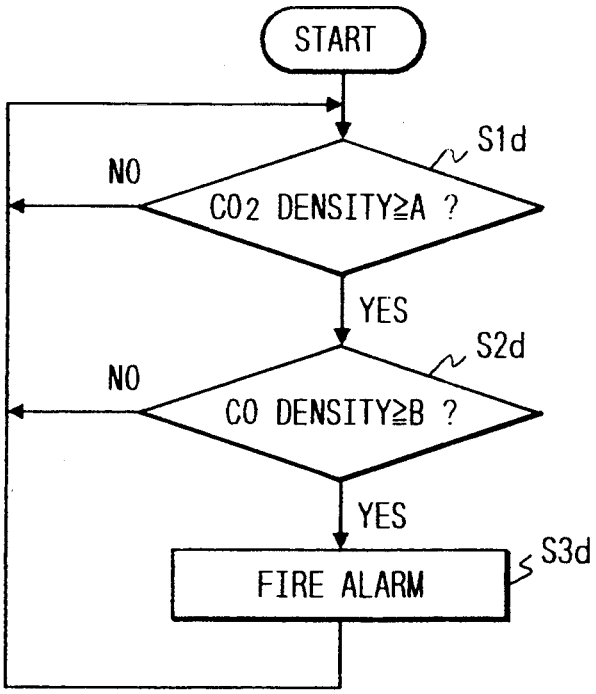
FIG. 21 is a flowchart showing the processing of a fire sensor shown in FIG. 20.

FIG. 20 is a diagram showing a configuration of yet another embodiment. This embodiment is characterized as judging a fire by performing processing shown in the flowchart of FIG. 21 by the comparison section 34D while using two detection outputs of the $CO_2$ sensor 31 and the CO sensor 32. More specifically, as shown in the flowchart of FIG. 21, it is judged that the $CO_2$ content is greater than or equal to the threshold A in Step S1d. If the $CO_2$ content is greater than or equal to the threshold A, then the processing proceeds to Step S2d. In Step S2d, it is judged whether or not the CO content is greater than or equal to the threshold B. If the CO content is greater than the threshold B, the processing is proceeded to Step S3d, where a fire alarm is given.

While fire judgment is carried out by comparing the contents of $CO_2$, CO, and $O_2$ with the predetermine thresholds A, B, C, respectively, fire judgment may be made based on a rate of increase or decrease per unit time, i.e., a differential. Further, fire judgment may be made by finding a plurality of pieces of data while sampling the content of each gas at a predetermined cycle, determining coefficients of, e.g., a quadratic function for prediction, and predicting a remaining time before reaching dangerous gas density level.

As described above, the invention allows a fire to be detected and a prealarm to be given at a very early stage of the fire before ignition, which is based on detection of hydrocarbon gas, through which early discovery of the phenomenon of fire is achieved, neither the $CO_2$ gas sensor, the CO gas sensor, nor the $O_2$ gas sensor could sense unless the combustion process starts. Also, by combining the detection of hydrocarbon gas with the detection of $CO_2$ gas, a change only in the content of $CO_2$ gas due to smoking a cigarette or a like non-fire phenomenon can be processed as environmental deterioration other than fires.

As described above, the invention can judge a fire surely compared with fire sensor employing a single gas sensor. Also, a fire can be judged based on simple processing without recourse to complicated signal processing or information processing. That is, by defining the tendencies to produce $CO_2$ gas, CO gas, and $O_2$ gas at a fire as three theorems based on the research concerning combustion, a comparison is made on the gases to see that the produced gases match these theorems.

Further, since gases are produced quickly than heat or smoke, fires can be located quickly.

What is claimed is:

1. A fire sensing method comprising the steps of:
monitoring gas content in a defined area;
storing a reference spectral pattern representing a fire condition based upon combustible gases;
detecting hydrocarbon gas which is produced at a very early state of fire before ignition;
outputting a pre-alarm signal upon detection of said hydrocarbon gas indicating a potential fire condition;
performing spectral analysis of said gas content an increase in level of combustible gases;
comparing a detected spectral pattern with spectral pattern to determine whether a fire condition exists;
generating a signal to indicate the detection of fire only when both said hydrocarbon gas is detected and said detected spectral pattern corresponds to said reference pattern.

2. A fire sensing method comprising the steps of:
detecting hydrocarbon gas which is produced at a very early state of fire before ignition;
outputting a pre-alarm signal upon detection of said hydrocarbon gas indicating a possible fire condition;
detecting a second gas which is produced after fire ignition;
detecting one of a significant increase and significant decrease in said second gas after detection of said hydrocarbon indicating a fire condition; and
outputting a signal indicating detection of a fire only when both said hydrocarbon gas is detected and said one of an increase and decrease is detected in said second gas.

3. The method of claim 2, wherein said first gas is a hydrocarbon gas and said second gas is at least one of $CO_2$, CO and $O_2$.

4. The method of claim 3, wherein said second gas comprises $O_2$ and said second gas detecting step comprises detecting a significant decrease in $O_2$ gas.

5. The method of claim 3, wherein said second gas comprises detecting a significant increase in at least one of CO and $CO_2$ gas.

6. A fire sensing method comprising the steps of:
detecting hydrocarbon gas which is produced at a very early state of fire before ignition;
detecting at least one of radiated heat and temperature; and
generating a signal to indicate the detection of fire only when said hydrocarbon gas has been detected and when said at least one of said radiated heat and temperature is detected after detection of said hydrocarbon gas.

7. The method of claim 6, wherein said step of detecting said at least one of radiated heat and temperature comprises sensing when one of said radiated heat and said temperature exceeds respective predetermined values.

8. The method of claim 6, wherein said step of detecting at least one of radiated heat and temperature comprises sensing when an incremental value per unit of time of one of said radiated heat temperature exceeds respective predetermined values.

9. A fire sensing method comprising the steps of:
detecting hydrocarbon gas at a very early state of a fire before ignition;
detecting a second gas which is produced after fire ignition;
detecting one of an increase and decrease in amount of said second gas; and
generating a signal to indicate detection of a fire only when both said hydrocarbon gas is detected and said one of an increase and decrease in said second gas is detected.

10. A fire sensing method as set forth in claim 9, wherein said detecting step for detecting said one of an increase and decrease in said second gas is based on a rate of change of a said amount per unit of time.

11. A fire sensing method comprising the step of:
determining whether hydrocarbon gas is present in a monitored region;
detecting at least a first gas and a second gas producing during a combustion process;
detecting an increase in both said first gas and said second gas; and
generating an alarm when an increase in both said first gas and said second gas is detected.

12. A fire sensor comprising:
a hydrocarbon gas sensor for detecting hydrocarbon gas produced before ignition;
a combustion gas sensor for detecting gases produced during a combustion process caused by said fire;
a fire judgment section for detecting the occurrence of a fire based upon whether said hydrogen gas is detected and whether said gases produced said combustion process are detected; and a pre-alarm judgment section, coupled to said sensor, for outputting a pre-alarm signal to said fire judgment section and to an alerting device in response to detection of said hydrocarbon gas which represents an initial stage of a fire;

said fire judgment section judging said fire from one of an increase and decrease of said gases detected by said combustion gas sensor only after said pre-alarm judgement section receives a signal from said hydrocarbon gas sensor indicating detection of hydrocarbon gas and outputting a fire alarm signal.

13. A fire sensor according to claim 12, wherein said combustion gas sensor detects at least one of $CO_2$ gas, CO gas and $O_2$ gas, and wherein said fire judgment section judges a fire when at least one of (1) said $CO_2$ gas and CO gas detected by said combustion gas sensor has been increased drastically after said detection of said hydrocarbon gas, and (2) said $O_2$ gas detected by said combustion gas sensor is decreased drastically.

14. A fire sensor according to claim 13, wherein said fire judgment section warns that an environment monitored by said fire sensor is being deteriorated by changes in levels of at least one of $CO_2$ gas, CO gas and $O_2$ gas as indicated by said combustion gas sensor when said hydrocarbon gas has not been detected.

15. A fire sensor according to claim 12, further comprising a radiation sensor for sensing radiation heat generated by exothermic reaction in the combustion process, said fire judgement section detecting the occurrence of fire in response to both outputs of said hydrocarbon gas sensor and said radiation sensor.

16. A fire sensor according to claim 15, wherein said radiation sensor comprises a pyroelectric element having a detection sensitivity in the infrared region.

17. A fire sensor according to claim 12, further comprising a spectral analyzer means for determining a spectral content of gas in a monitored environment, said fire judgement section detecting the occurrence of fire in response to both outputs of said hydrocarbon gas sensor and said spectral analyzer means.

18. A fire sensor according to claim 17, wherein said fire judgment section is operative to store a reference spectral pattern and to compare the spectral pattern from said spectral analyzer means with said reference spectral pattern for detecting the occurrence of a fire.

19. A fire sensor according to claim 15, wherein a prealarm is produced when said hydrocarbon gas sensor detects a hydrocarbon.

20. A combination fire sensor comprising:

a $CO_2$ sensor for detecting $CO_2$ gas produced at a fire;

a CO sensor for detecting CO gas produced at said fire; and a comparison section for giving an alarm by judging said fire when a content of said $CO_2$ gas detected by said $CO_2$ sensor has been increased over a predetermined threshold and when a content of said CO gas detected by said CO sensor has been increased above a predetermined threshold.

21. The combination fire sensor as set forth in claim 20, wherein said comparison section is sensitive to changes in detected gas amount per unit of time.

22. A fire sensor comprising:

first means for detecting a hydrocarbon gas and generating a first output signal;

second means for detecting the presence of a fire and generating a second output signal;

third means responsive to at least said second signal for generating a fire alarm, said third means being responsive to the presence of said first signal for setting a first threshold alarm condition for said second output signal, said first threshold alarm condition being more sensitive than a second threshold alarm condition for said second signal alone.

* * * * *